US010670995B2

(12) United States Patent
Kawashima

(10) Patent No.: US 10,670,995 B2
(45) Date of Patent: Jun. 2, 2020

(54) IMAGE FORMING APPARATUS

(71) Applicant: CANON KABUSHIKI KAISHA, Tokyo (JP)

(72) Inventor: Tomomichi Kawashima, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/265,718

(22) Filed: Feb. 1, 2019

(65) Prior Publication Data

US 2019/0250537 A1 Aug. 15, 2019

(30) Foreign Application Priority Data

Feb. 9, 2018 (JP) ..... 2018-022021

(51) Int. Cl.
*G03G 15/16* (2006.01)
*G03G 21/16* (2006.01)
*G03G 21/12* (2006.01)

(52) U.S. Cl.
CPC ..... *G03G 15/161* (2013.01); *G03G 21/12* (2013.01); *G03G 21/169* (2013.01); *G03G 2215/1661* (2013.01); *G03G 2221/1684* (2013.01)

(58) Field of Classification Search
CPC ..... G03G 15/161; G03G 21/12
See application file for complete search history.

(56) References Cited

U.S. PATENT DOCUMENTS

2011/0229192 A1* 9/2011 Okamoto ..... G03G 21/1623 399/110
2011/0293318 A1* 12/2011 Nakano ..... G03G 15/6511 399/101

FOREIGN PATENT DOCUMENTS

JP 2011-248167 A 12/2011
JP 2014-25994 A 2/2014
JP 2016-57543 A 4/2016
JP 2017-15896 A 1/2017

* cited by examiner

*Primary Examiner* — Gregory H Curran
(74) *Attorney, Agent, or Firm* — Canon U.S.A. Inc., IP Division

(57) ABSTRACT

An image forming apparatus includes an image forming portion that forms a toner image on a photosensitive member in accordance with image information, an intermediate transfer member that carries the toner image transferred from the photosensitive member, a transfer portion that transfers the toner image carried by the intermediate transfer member onto a recording medium, a cleaning portion that collects toner remaining on the intermediate transfer member, and a toner collecting container into which the toner conveyed from the cleaning portion is collected. In the image forming apparatus, the toner collecting container is disposed in a region above the intermediate transfer member.

10 Claims, 6 Drawing Sheets

IMAGE FORMING APPARATUS

BACKGROUND OF THE INVENTION

Field of the Invention

The present disclosure generally relates to an image forming apparatus employing an electrophotographic process, such as a copier or a printer. More particularly, the present disclosure relates to an image forming apparatus having a toner collecting container that accommodates collected toner that has not been utilized for forming an image in an image transfer process.

Description of the Related Art

An image forming apparatus that employs an electrophotographic process forms an image on a recording medium, such as a sheet of paper or a piece of cloth. Typical examples of the image forming apparatus are electrophotographic copiers, electrophotographic printers, or the like.

A type of the image forming apparatus employs a processing cartridge system in which a photosensitive drum and processing devices that act on the photosensitive drum are integrally formed into a single cartridge and the cartridge is detachably mounted on the main body of the image forming apparatus. The processing cartridge system enables a user to perform maintenance of the apparatus without a service person, thereby improving usability. Accordingly, the processing cartridge system is widely adopted in the image forming apparatuses that employ the electrophotographic process.

Multicolor image forming apparatuses that employ the electrophotographic process are also used widely. A type of multicolor image forming apparatus available on the market is an inline color image forming apparatus in which multiple photosensitive drums corresponding to respective colors are arranged in a row and color toner images formed on the respective photosensitive drums are sequentially overlaid on each other on an intermediate transfer member so as to form a color image.

In this system, residual toner that has not been secondary-transferred from the intermediate transfer member onto a recording medium, such as a sheet of paper, is collected from the intermediate transfer member by a cleaning device. A known cleaning device uses a cleaning blade, which serves as a cleaning member. The cleaning blade, which is brought into pressure contact with the intermediate transfer member, scrapes residual toner off the intermediate transfer member. The residual toner scraped off is collected into a toner collecting container that is disposed inside the image forming apparatus (for example, see Japanese Patent Laid-Open Nos. 2014-25994, 2016-57543, 2011-248167, and 2017-15896).

When the toner collecting container is filled with collected residual toner, the toner collecting container is replaced with a new one.

In recent years, image forming apparatuses for office use have been subject to downsizing and space saving. The main trend is a type of image forming apparatus in which both of the processing unit and the toner collecting container can be replaced from one side of the image forming apparatus (see Japanese Patent Laid-Open No. 2014-25994).

The toner collecting container needs to be replaced when it becomes full. In order to reduce the number of replacements of the toner collecting container, a toner collecting container needs to have a large volume (see Japanese Patent Laid-Open No. 2016-57543).

Japanese Patent Laid-Open No. 2014-25994 discloses an image forming apparatus that includes a toner cartridge that is detachably mounted on the image forming apparatus from one side thereof and a collecting container that is disposed in a region below the toner cartridge. The image forming apparatus also includes a side door that is attached to the one side of the apparatus. The toner cartridge and the toner collecting container can be attached/detached when the side door is open. In this configuration, opening the side door enables the toner cartridge and the toner collecting container to be replaced. However, the space for accommodating the toner collecting container is limited because the processing unit that has the intermediate transfer belt is also disposed more inside of the image forming apparatus than the toner collecting container. Accordingly, in order to increase the volume of the toner collecting container, it is necessary to enlarge the toner collecting container laterally, which affects the size of the image forming apparatus in the width direction. In addition, when the processing unit having the intermediate transfer belt is replaced, it is necessary to dismantle the toner cartridge and the toner collecting container from the apparatus, which makes replacement work complicated (FIG. 7).

Japanese Patent Laid-Open No. 2016-57543 proposes an image forming apparatus equipped with a fixed toner collecting container that is fixed to the main body of the apparatus and a replaceable toner collecting container that can be detachably mounted on the main body of the apparatus. In the configuration of Japanese Patent Laid-Open No. 2016-57543, these toner collecting containers are disposed next to the row of the processing cartridges at a position between the opening/closing cover and the processing cartridges in order to accommodate large capacity toner collecting containers in a limited space in an image forming apparatus. In this case, enlarging the toner collecting container affects the size of the image forming apparatus in the width direction (see FIG. 8).

In the configurations of Japanese Patent Laid-Open No. 2014-25994 and Japanese Patent Laid-Open No. 2016-57543, as described above, a space above the intermediate transfer member is not utilized effectively.

SUMMARY OF THE INVENTION

The present disclosure generally provides for an image forming apparatus including a toner collecting container and more specifically to an image forming apparatus in which the capacity of a toner collecting container is obtained by utilizing a space above an intermediate transfer member, which can reduce the need for the upsizing of the image forming apparatus.

The present disclosure provides an image forming apparatus that includes an image forming portion that is detachable from the main body of the image forming apparatus and forms a toner image on a photosensitive member in accordance with image information, an intermediate transfer member that carries the toner image transferred from the photosensitive member, a transfer portion that transfers the toner image carried by the intermediate transfer member onto a recording medium, a cleaning portion that collects toner remaining on the intermediate transfer member, a toner collecting container into which the toner conveyed from the cleaning portion is collected, and a cover that is movable between an open position at which the toner collecting container is exposed and a closed position at which the toner collecting container is covered. In the image forming apparatus, the toner collecting container is disposed in a region above the intermediate transfer member, and the toner collecting container is detachable from the main body in a state in which the cover is at the open position and the toner collecting container does not overlap the image forming portion when the toner collecting container is viewed in an attaching and detaching direction.

In addition, the present disclosure provides an image forming apparatus that includes an image forming portion that forms a toner image on a photosensitive member in accordance with image information, an intermediate transfer member that carries the toner image transferred from the photosensitive member, a transfer portion that transfers the toner image carried by the intermediate transfer member onto a recording medium, a cleaning portion that collects toner remaining on the intermediate transfer member, a toner collecting container into which the toner conveyed from the cleaning portion is collected, and a stacking portion that has a first inclined surface on which the recording medium having the toner image is stacked. In the image forming apparatus, the toner collecting container is disposed in a region above the intermediate transfer member, and the toner collecting container has a second inclined surface that matches the first inclined surface of the stacking portion.

Further features of the present disclosure will become apparent from the following description of exemplary embodiments with reference to the attached drawings.

DESCRIPTION OF THE EMBODIMENTS

Exemplary embodiments according to the disclosure will be described with reference to the drawings. Note that dimensions, materials, shapes, relative positions, or the like, of elements described in the embodiments below may be changed appropriately in accordance with configurations and various conditions of an apparatus to which the present disclosure is applied. In other words, the embodiments described below should not be construed as limiting the scope of the disclosure.

First Embodiment

In the present embodiment, a color image forming apparatus using an electrophotographic process and quadruple drums will be described by way of example. The image forming apparatus is an apparatus that forms a toner image based on image information entered from an external device and that transfers the toner image onto a recording medium, such as a sheet of paper, and fixes the toner image thereon to provide a color image. Although the image forming apparatus encompasses various types, such as a copier, a laser beam printer, or a facsimile machine, the present embodiment will be described by using a color laser beam printer as an example.

In addition, a processing cartridge is a cartridge that includes, as processing devices, at least a developing device and a photosensitive drum that is a photosensitive member for electrophotography. The processing cartridge, into which the developing device and the photosensitive member are integrally formed, can be detachably mounted on the main body of the image forming apparatus. The main body here is a portion of the image forming apparatus from which at least the processing cartridge is excluded.

Note that when the front side of the image forming apparatus is viewed, the right side of the image forming apparatus is positioned on the right and the left side of the image forming apparatus is positioned on the left.

Image Forming Apparatus

Figure 1:
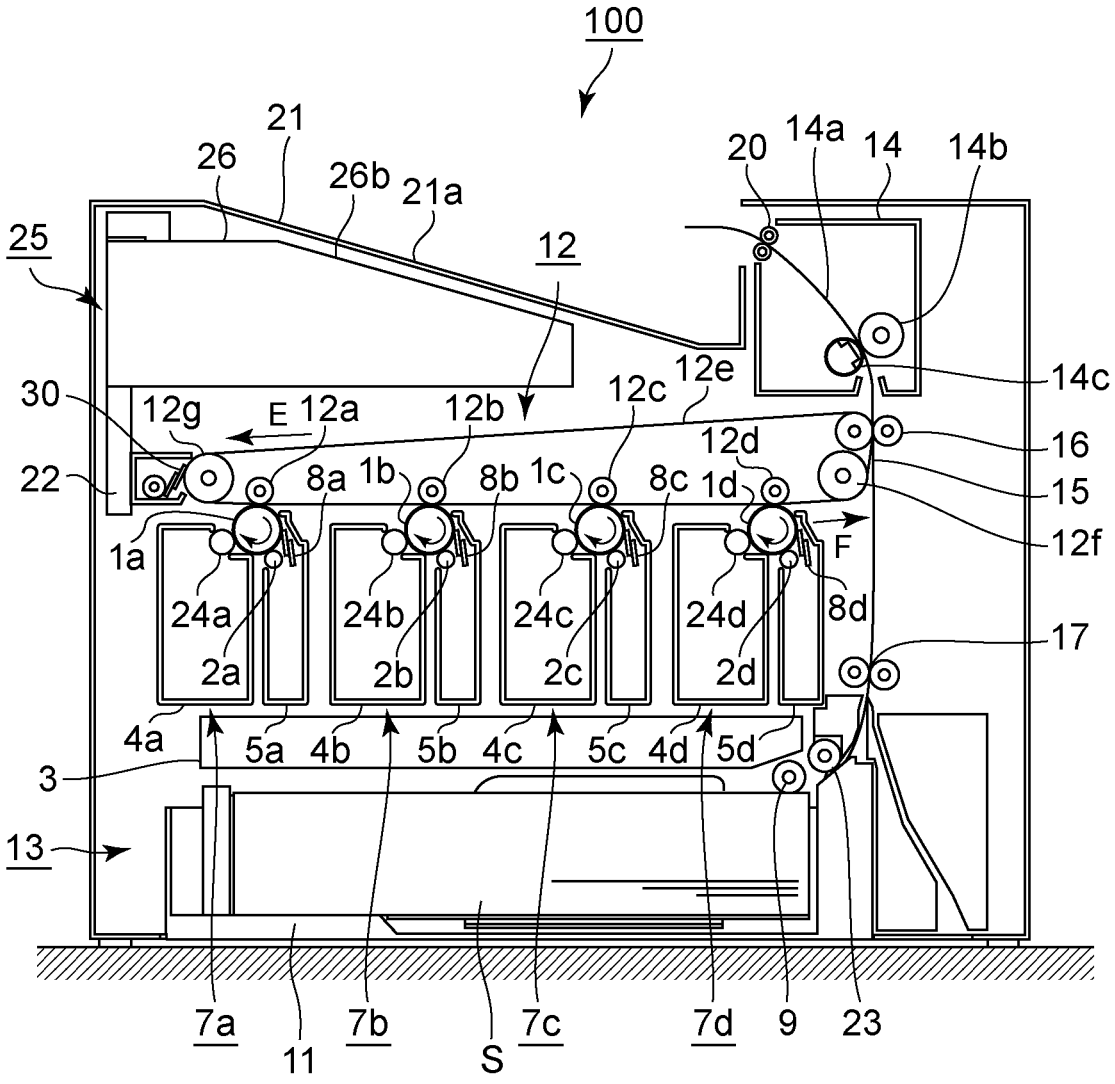
FIG. 1 is a cross-sectional view illustrating part of an image forming apparatus according to an embodiment.

FIG. 1 is a cross-sectional view schematically illustrating a structure of the image forming apparatus when the front side of the image forming apparatus is viewed.

FIG. 1 illustrates a tandem (or inline) type color image forming apparatus in which four processing cartridges 7*a*, 7*b*, 7*c*, and 7*d* are arranged along a straight line. An intermediate transfer belt, which serves as an intermediate transfer member, is disposed above the processing cartridges, which serve as image forming portions. A toner collecting container that collects toner is disposed in a region above the intermediate transfer belt. In addition, a cleaning portion that cleans the intermediate transfer belt is disposed in a region above the processing cartridges (i.e., the image forming portions), and the toner collecting container is disposed in a region above the cleaning portion. In FIG. 1, the right side of the apparatus is on the right, and the left side of the apparatus is on the left.

Forming Process of Toner Image

Toner image forming is performed by using photosensitive drums 1, charging devices 2, an exposing device 3, and developing units 4. The photosensitive drums 1 serve as photosensitive members, and the developing units 4 serve as developing devices. An image forming apparatus 100 is equipped with four photosensitive drums 1*a*, 1*b*, 1*c*, and 1*d*. A charging device 2 (2*a*, 2*b*, 2*c*, or 2*d*) and the exposing device 3 are disposed around each of the photosensitive drums 1 in order in the drum rotation direction. The charging device 2 electrically charges the surface of the photosensitive drum 1 uniformly. The exposing device emits a laser beam in accordance with image information and thereby forms an electrostatic latent image on the photosensitive drum 1 (i.e., on the photosensitive member). A developing unit 4 (4*a*, 4*b*, 4*c*, or 4*d*) and a transfer device 12*a*, 12*b*, 12*c*, or 12*d* are also disposed around the photosensitive drum 1. The developing unit 4 develops the electrostatic latent image into a visible toner image by adhering toner to the electrostatic latent image. The transfer device 12*a*, 12*b*, 12*c*, or 12*d* transfers the toner image formed on the photosensitive drum 1 (i.e., on the photosensitive member) onto an intermediate transfer belt 12*e*. Moreover, a cleaning device 8 (8*a*, 8*b*, 8*c*, or 8*d*) is disposed around the photosensitive drum 1. The cleaning device 8 removes residual toner remaining on the surface of the photosensitive drum 1 after the transfer.

The photosensitive drum 1, the charging device 2, the developing unit 4, and the cleaning device 8 are integrated into a single cartridge, thereby forming each of the processing cartridges 7 (7*a*, 7*b*, 7*c*, and 7*d*). Each of the processing cartridges 7 is detachably mounted on the main body of the image forming apparatus 100. In the present embodiment, the processing cartridges 7 are configured to be able to be mounted from the front side of the image forming apparatus 100. These four processing cartridges 7*a*, 7*b*, 7*c*, and 7*d* have the same structure. The difference is that each processing cartridge 7 forms an image of different color by using toner of yellow (Y), magenta (M), cyan (C), or black (Bk). In a case in which toner of black (Bk) is consumed more, the processing cartridge for black (Bk) may be formed so as to be larger than processing cartridges for other colors.

The processing cartridge 7*a*, 7*b*, 7*c*, or 7*d* is constituted mainly by the developing unit 4*a*, 4*b*, 4*c*, or 4*d* and a cleaning unit 5*a*, 5*b*, 5*c*, or 5*d*. The developing unit 4*a*, 4*b*, 4*c*, or 4*d* includes a developing roller 24*a*, 24*b*, 24*c*, or 24*d* and a toner container. The cleaning unit 5*a*, 5*b*, 5*c*, or 5*d* includes the photosensitive drum 1*a*, 1*b*, 1*c*, or 1*d*, the charging device 2*a*, 2*b*, 2*c*, or 2*d*, the cleaning device 8*a*, 8*b*, 8*c*, or 8*d*, and a residual toner container.

Each photosensitive drums 1*a*, 1*b*, 1*c*, or 1*d* is formed of an aluminum cylinder with an organic photoconductive (OPC) layer being coated on the outer periphery thereof. Both ends of the photosensitive drum 1*a*, 1*b*, 1*c*, or 1*d* are rotatably supported by flanges. Drive power from a drive motor is transmitted to one end of the photosensitive drum 1*a*, 1*b*, 1*c*, or 1*d*, thereby rotating the photosensitive drum 1*a*, 1*b*, 1*c*, or 1*d* clockwise as indicated by the arrow in FIG. 1.

The charging device 2*a*, 2*b*, 2*c*, or 2*d* is an electrically conductive roller. The roller is brought into contact with the surface of the photosensitive drum 1*a*, 1*b*, 1*c*, or 1*d*, and a charging voltage from a power source is applied to the roller. The surface of the photosensitive drum 1*a*, 1*b*, 1*c*, or 1*d* is thereby electrically charged uniformly.

The exposing device 3, which is disposed vertically under the processing cartridges 7 (7*a*, 7*b*, 7*c*, and 7*d*), exposes each of the photosensitive drums 1*a*, 1*b*, 1*c*, and 1*d* to light in accordance with an image signal.

Each of the toner containers in the developing units accommodates toner of yellow (Y), magenta (M), cyan (C), or black (Bk).

The developing roller 24*a*, 24*b*, 24*c*, or 24*d* is disposed adjacent to the corresponding photosensitive drum 1*a*, 1*b*, 1*c*, or 1*d*. While the developing roller 24*a*, 24*b*, 24*c*, or 24*d* is rotationally driven by a drive device and develops a latent image on the photosensitive drum 1*a*, 1*b*, 1*c*, or 1*d* by applying voltage.

As a result, the toner images of Y, M, C, and Bk are formed on the corresponding photosensitive drums 1*a*, 1*b*, 1*c*, and 1*d*, (i.e., the photosensitive members). The toner images formed on the respective surfaces of the photosensitive drums 1*a*, 1*b*, 1*c*, and 1*d* (i.e., the photosensitive members) are primary-transferred one after another onto the surface of the intermediate transfer belt 12*e* (i.e., the intermediate transfer member). The toner remaining on each of the photosensitive drums 1*a*, 1*b*, 1*c*, and 1*d* is removed by the corresponding cleaning device 8*a*, 8*b*, 8*c*, or 8*d* and is collected into the residual toner container disposed in the cleaning unit 5*a*, 5*b*, 5*c*, or 5*d*.

Image Transfer to Sheet and Fixing Process

A toner image is transferred onto a sheet S at a secondary transfer portion 15 to which the sheet S is conveyed by a feeder unit 13. An intermediate transfer unit 12 carries a toner image formed in the primary transfer process and conveys the toner image to the secondary transfer portion 15. A fixing device 14, which is located downstream of the secondary transfer portion 15 in the sheet S conveying direction, fixes the toner image that has been transferred on the sheet S.

First, configurations of a feeder unit 13, the intermediate transfer unit 12, and the fixing device 14 will be described.

The feeder unit 13 is constituted mainly by a sheet feeding cassette 11 in which sheets S are accommodated, a feed roller 9, a separation device 23, and a registration roller pair 17 that nips and conveys a sheet S. The sheet feeding cassette 11 can be withdrawn from the image forming apparatus 100. A user can replenish sheets S by withdrawing the sheet feeding cassette 11 from the image forming apparatus 100, setting sheets S therein, and installing the sheet feeding cassette 11 again in the image forming apparatus 100.

The intermediate transfer unit 12 is constituted by the intermediate transfer belt 12*e* (i.e., intermediate transfer member), a drive roller 12*f*, a driven roller 12*g*, primary transfer rollers 12*a*, 12*b*, 12*c*, and 12*d*, which serve as primary transfer devices, and a cleaning apparatus 22, which serves as a cleaning portion. The intermediate transfer belt 12*e* is an endless belt that is shaped like a cylinder and extends around the drive roller 12*f* and the driven roller 12*g*. The driven roller 12*g*, which is urged by an urging device in the direction of arrow E in FIG. 1, imparts a predetermined tension to the intermediate transfer belt 12*e*. The intermediate transfer belt 12*e* rotates at a predetermined speed in the direction of arrow F in FIG. 1 due to the drive roller 12*f* being rotationally driven by a motor or the like. The primary transfer rollers 12*a*, 12*b*, 12*c*, and 12*d* are disposed in the interior of the intermediate transfer belt 12*e* so as to oppose respective photosensitive drums 1*a*, 1*b*, 1*c*, and 1*d*. The toner images formed on the surfaces of the photosensitive drums 1*a*, 1*b*, 1*c*, and 1*d* are thereby primary-transferred onto the intermediate transfer belt 12*e* by applying a voltage to respective primary transfer rollers 12*a*, 12*b*, 12*c*, and 12*d*.

The fixing device 14 is constituted mainly by a fixing film 14*a*, a pressing roller 14*b*, a heating member 14*c*, and a discharge roller pair 20. The fixing film 14*a* is an endless belt shaped like a cylinder and is disposed in such a manner that the outer surface of the fixing film 14*a* faces the toner image that has been formed on the sheet S. The heating member 14*c* is disposed in the interior of the fixing film 14*a*, and the pressing roller 14*b* is in pressure contact with the heating member 14*c* with the fixing film 14*a* interposed therebetween. The fixing film 14*a* rotates due to the pressing roller 14*b* being rotationally driven by a driving device, and the heating member 14*c* heats the fixing film 14*a*.

The discharge roller pair 20 and a sheet discharge tray 21 are disposed downstream of the fixing film 14*a* in the sheet S conveying direction. The sheet discharge tray 21 has an inclined surface 21*a* that inclines with respect to a horizontal direction. The inclined surface 21*a* inclines such that the edge of the inclined surface 21*a* near the discharge roller pair 20 is lower than the other edge.

Next, operation of the feeder unit 13, the intermediate transfer unit 12, and the fixing device 14 will be described.

The feed roller 9, which is in pressure contact with sheets S accommodated in the sheet feeding cassette 11, starts to rotate at a predetermined control timing and dispatches sheets S. The sheets S are separated one by one and fed by separation device 23. The sheet S is subsequently conveyed to the secondary transfer portion 15 by the registration roller pair 17. Meanwhile, toner images of four colors are transferred onto the intermediate transfer belt 12*e* in an overlaid manner and then carried and conveyed to the secondary transfer portion 15 by the intermediate transfer belt 12*e*. In the secondary transfer portion 15, the toner image on the intermediate transfer belt 12*e* is transferred, by applying a bias to a secondary transfer device 16, onto the sheet S conveyed to the secondary transfer portion 15. The toner remaining on the intermediate transfer belt 12*e* after the secondary transfer is removed by the cleaning apparatus 22 (i.e., the cleaning portion) and conveyed to a toner collecting container 26 that is disposed in the image forming apparatus 100. The sheet S conveyed from the secondary transfer portion 15 is subsequently nipped and conveyed further by the fixing film 14*a* and the pressing roller 14*b*, and the toner image is thereby fixed on the sheet S. The sheet S on which the toner image has been fixed is subsequently nipped and conveyed by the discharge roller pair 20 and discharged onto the sheet discharge tray 21. The sheet discharge tray 21 serves as a stacking portion on which multiple sheets S are stacked. The inclined surface 21*a* is formed on the sheet discharge tray 21 (i.e., the stacking portion) in order to maintain orderly arrangement of sheets S even in a case in which sheets P are discharged successively onto the sheets S that have already been stacked on the sheet discharge tray 21. Because of the inclination of the stacked sheets S, discharged sheets S are stacked on the sheet discharge tray 21 (i.e., the stacking portion) in an orderly manner without pushing other sheets S out of the stack.

Cleaning Apparatus

Figure 2:
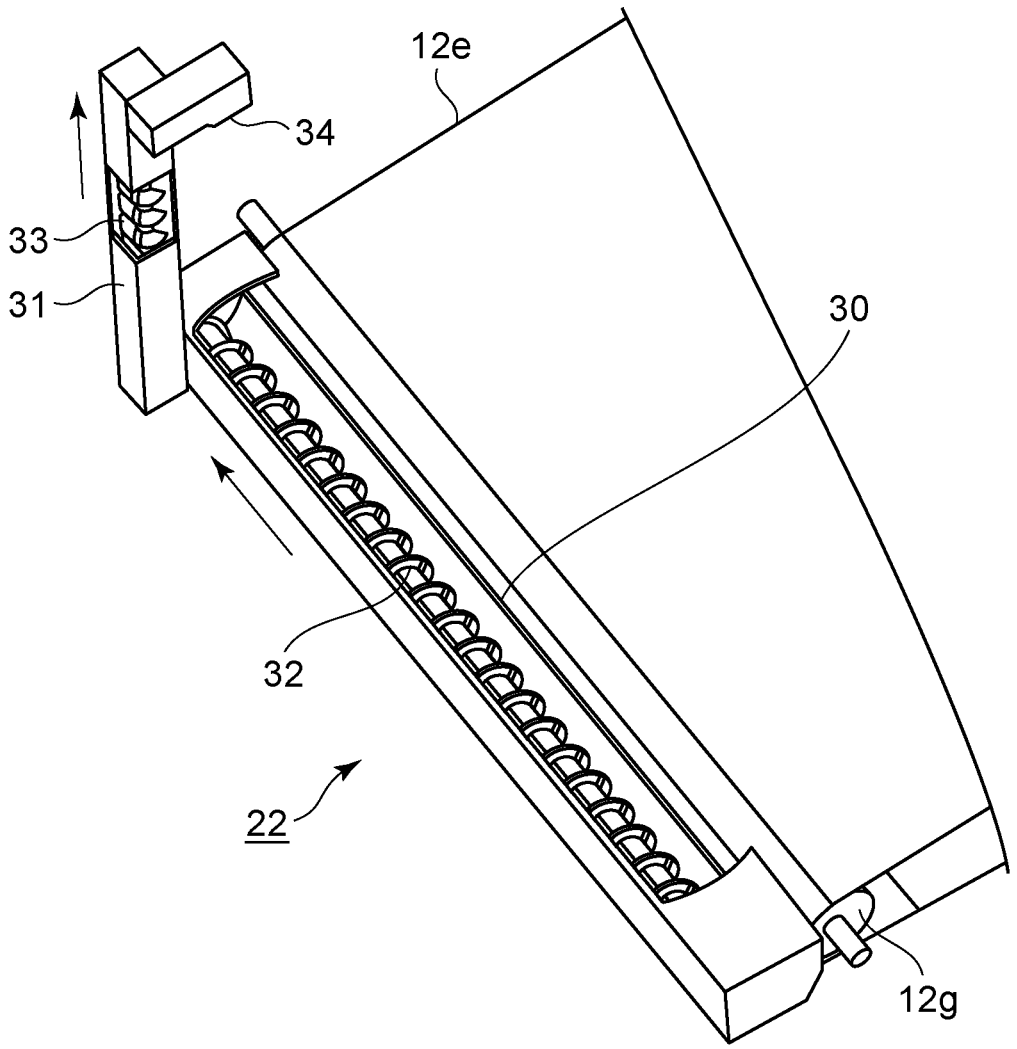
FIG. 2 is a perspective view illustrating part of a cleaning apparatus according to the embodiment.

FIG. 2 illustrates an example of the cleaning apparatus 22 according to the present embodiment.

A configuration of the cleaning apparatus 22 (i.e., the cleaning portion) will be described.

The cleaning apparatus 22 (i.e., the cleaning portion) includes a cleaning blade 30, a toner accommodation portion that accommodates toner that has been scraped off by the cleaning blade 30, and a toner conveying device 32 that conveys toner from the toner accommodation portion. The cleaning apparatus 22 also includes a toner conveying path 31 that serves as a toner conveying portion for conveying toner accommodated in the toner accommodation portion to the toner collecting container 26. The toner conveying path 31 (i.e., the toner conveying portion) has a discharge port at the end thereof for discharging the toner conveyed to the toner collecting container 26. The cleaning blade 30 is disposed so as to oppose the intermediate transfer belt 12*e* that extends around the driven roller 12*g*. The edge of the cleaning blade 30 is brought into contact with the intermediate transfer belt 12*e* with a predetermined contact pressure. A toner conveying device 33 having a spiral shape is disposed inside the toner conveying path 31 (i.e., the toner conveying portion). The toner conveying device 33 is connected to, and rotationally driven by, a driving device, such as a motor (not illustrated). The toner conveying device 33 conveys toner in the direction indicated by the arrows in FIG. 2, that is, downstream in the toner conveying direction.

Next, operation of the cleaning apparatus 22 will be described.

Residual toner remaining on the intermediate transfer belt 12*e* after the secondary transfer is scraped off by the cleaning blade 30. The toner that has been scraped off is stored temporarily in the toner accommodation portion. The toner in the toner accommodation portion is subsequently conveyed to the toner conveying path 31 by the toner conveying device 32. The toner in the toner conveying path 31 is conveyed in the direction indicated by the arrow in FIG. 2 by the toner conveying device 33 disposed inside the toner conveying path 31. The toner is collected from the discharge port into the toner collecting container 26 through a collection opening of the toner collecting container 26.

Toner Collecting Apparatus

Figure 3:
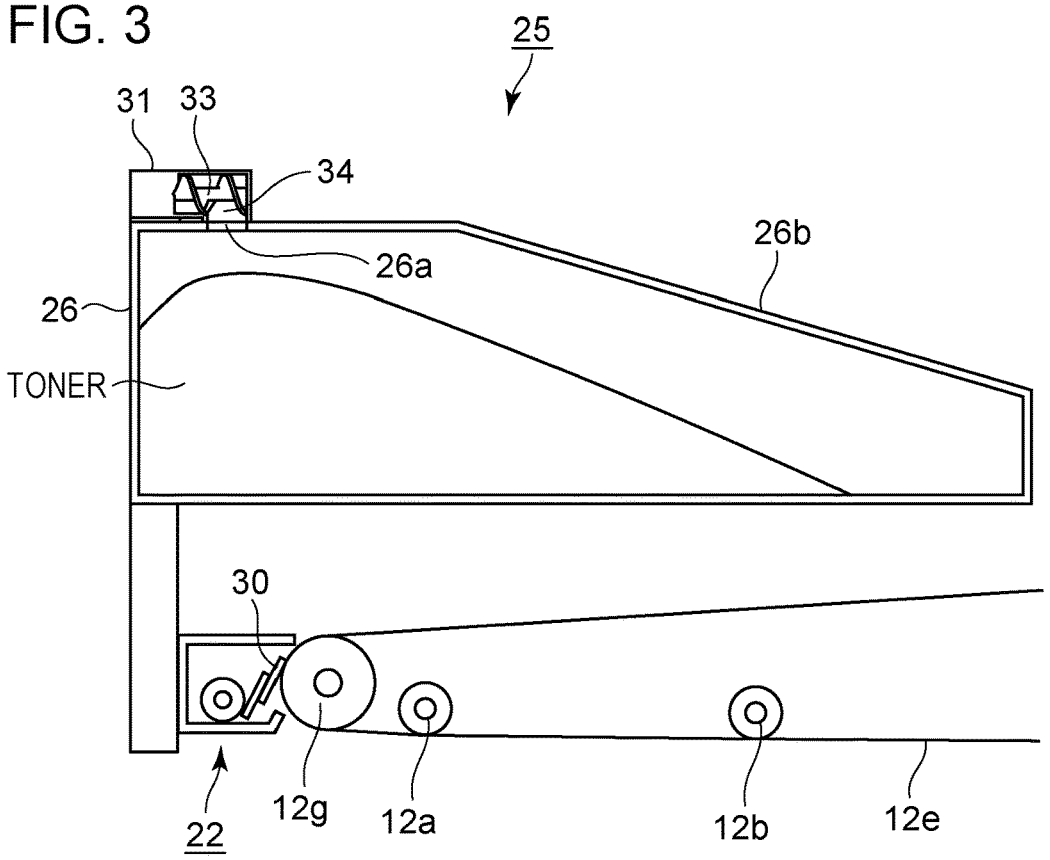
FIG. 3 is a cross-sectional view illustrating part of a toner collecting apparatus according to the embodiment.

FIG. 3 illustrates an example of a toner collecting apparatus 25 according to the present embodiment.

A configuration of the toner collecting apparatus 25 will be described below.

The toner collecting apparatus 25 is constituted by the toner collecting container 26 and an opening 26*a* (i.e., a collection opening) through which toner enters the toner collecting container 26. The toner collecting container 26 is disposed in a region above the intermediate transfer belt 12*e* within the image forming apparatus 100. The toner collecting container 26 is disposed at a level above the cleaning blade 30 of the cleaning apparatus 22 and the toner accommodation portion. With this configuration, the toner collecting container 26 can be detachably installed in the image forming apparatus 100 from the front side thereof. The opening 26*a*, which serves as the collection opening, is provided on the upper surface of the toner collecting container 26. In the state in which the toner collecting container 26 is installed in the image forming apparatus 100, the opening 26*a* opposes a discharge port 34 that is provided in a downstream region of the toner conveying path 31 of the cleaning apparatus 22. The opening 26*a* (i.e., the collection opening) engages the discharge port 34 so that the toner from the discharge port 34 can enter the collection opening without spillage. The discharge port 34 and the opening 26*a* are provided within the image forming apparatus 100 at a position away from the front side, or near the rear side, of the image forming apparatus 100. In other words, the discharge port 34 and the opening 26*a* are provided at a position away from an opening/closing cover for exposing the toner collecting container 26 when the toner collecting container 26 is detached/attached. The toner collecting container 26 is a container for collecting toner from the opening 26*a*. When the toner collecting container 26 is detached from the main body of the image forming apparatus 100, a shutter member closes the opening 26*a* so as to suppress spillage of toner.

An area that is opposite to the opening 26*a* on the upper surface of the toner collecting container 26 forms an inclined surface 26*b* (a second inclined surface). As illustrated in FIG. 1, the inclined surface 26*b* (the second inclined surface) is formed so as to adjoin the inclined surface 21*a* (the first inclined surface) of the sheet discharge tray 21. Accordingly, the inclined surface 26*b* (i.e., the second inclined surface) declines from the opening 26*a* (i.e., the collection opening) of the toner collecting container 26 in the direction of gravity. The inclined surface 26*b* (i.e., the second inclined surface) of the toner collecting container 26 is formed so as to oppose the inclined surface 21*a* (i.e., the first inclined surface) of the sheet discharge tray (i.e., the stacking portion). Thus, the interior space above the intermediate transfer belt can be utilized effectively.

Next, operation of the toner collecting apparatus 25 will be described.

The toner conveyed inside the toner conveying path 31 is discharged through the discharge port 34 into the toner collecting container 26. The toner discharged accumulates inside the toner collecting container 26. The toner accumulates like a pile with the apex formed immediately under the opening 26*a*.

The space inside the image forming apparatus 100 can be utilized effectively by disposing the inclined surface 26*b* on an area of the upper surface of the toner collecting container 26 so as to adjoin the inclined surface 21*a*. As a result, the volume of the toner collecting container 26 can be increased.

The toner that piles up in the toner collecting container 26 also accumulates in a region under the inclined surface 26*b* inside the toner collecting container 26.

As illustrated in FIG. 1, in the image forming apparatus 100 in which the processing cartridges 7 and the intermediate transfer belt 12*e* are arranged substantially horizontally, a substantially triangular space in the cross-sectional view is formed under the sheet discharge tray 21. By utilizing this space, the toner collecting container 26 can be disposed without affecting the size of the image forming apparatus 100 in the height direction.

As illustrated in FIG. 1, the toner collecting container 26 can be disposed in the image forming apparatus 100 without overlapping main components such as the image forming portions in the cross-sectional view. As a result, the size of the toner collecting container 26 can be increased especially in the front-rear direction without affecting the size of the image forming apparatus 100. In other words, when the toner collecting container 26 is viewed in the direction of attaching/detaching the toner collecting container 26, the toner collecting container and the image forming portions do not overlap each other. At the same time, the toner collecting container and the intermediate transfer member do not overlap each other, and the intermediate transfer member and the image forming portions do not overlap each other, either.

Figure 4:
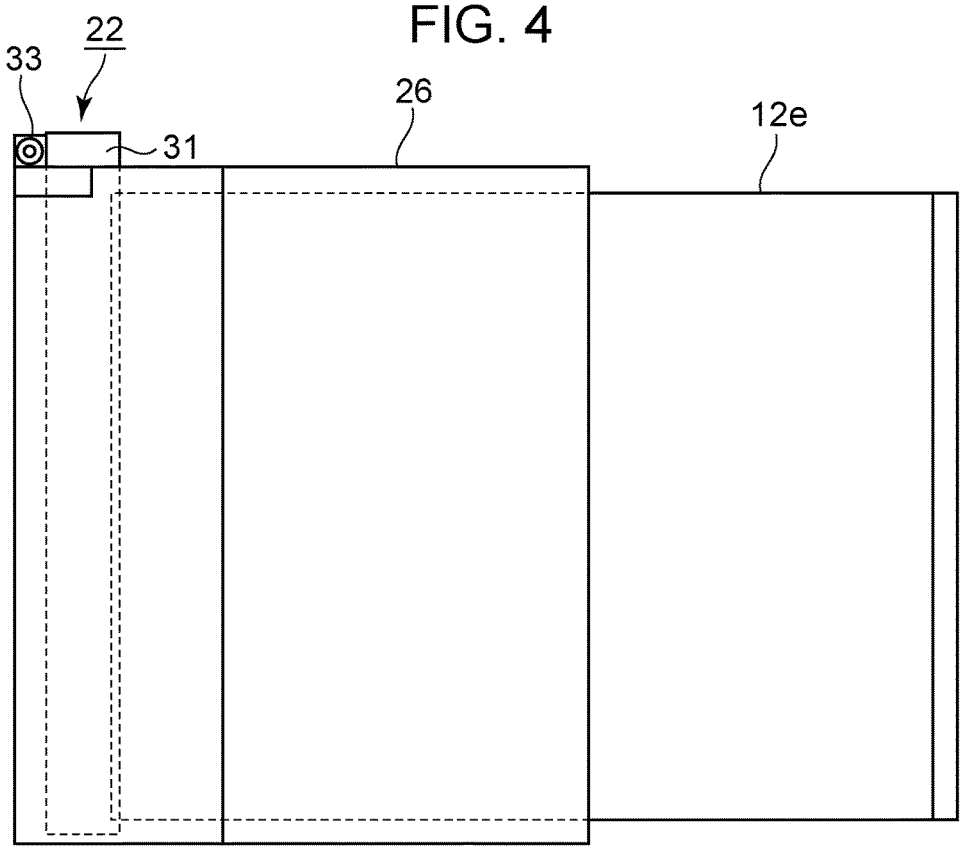
FIG. 4 is a plan view illustrating part of a toner collecting container according to the embodiment.

FIG. 4 illustrates an example of the toner collecting container. In the present embodiment, a large volume of the toner collecting container 26 is obtained by enlarging the toner collecting container 26 to a size similar to that of the intermediate transfer belt 12*e* in the front-rear direction. In other words, the length of the toner collecting container in the longitudinal direction of a photosensitive drum (i.e., a photosensitive member) is more than the length of the intermediate transfer belt (i.e., intermediate transfer member) in the longitudinal direction of the photosensitive member. In addition, in the longitudinal direction of the photosensitive drum (i.e., the photosensitive member), the length of the toner collecting container is preferably about 90% to 110% of the length of the intermediate transfer belt. Thus, the space above the intermediate transfer belt can be utilized effectively.

In addition, when viewed in the direction of gravity, the toner collecting container overlaps the intermediate transfer member. It is preferable that the toner collecting container be disposed in such a manner that the area of the overlapping portion is at least 50% to 90% of the area of the toner collecting container, where the area of the toner collecting container is 100%.

Opening/Closing Cover

Figure 5:
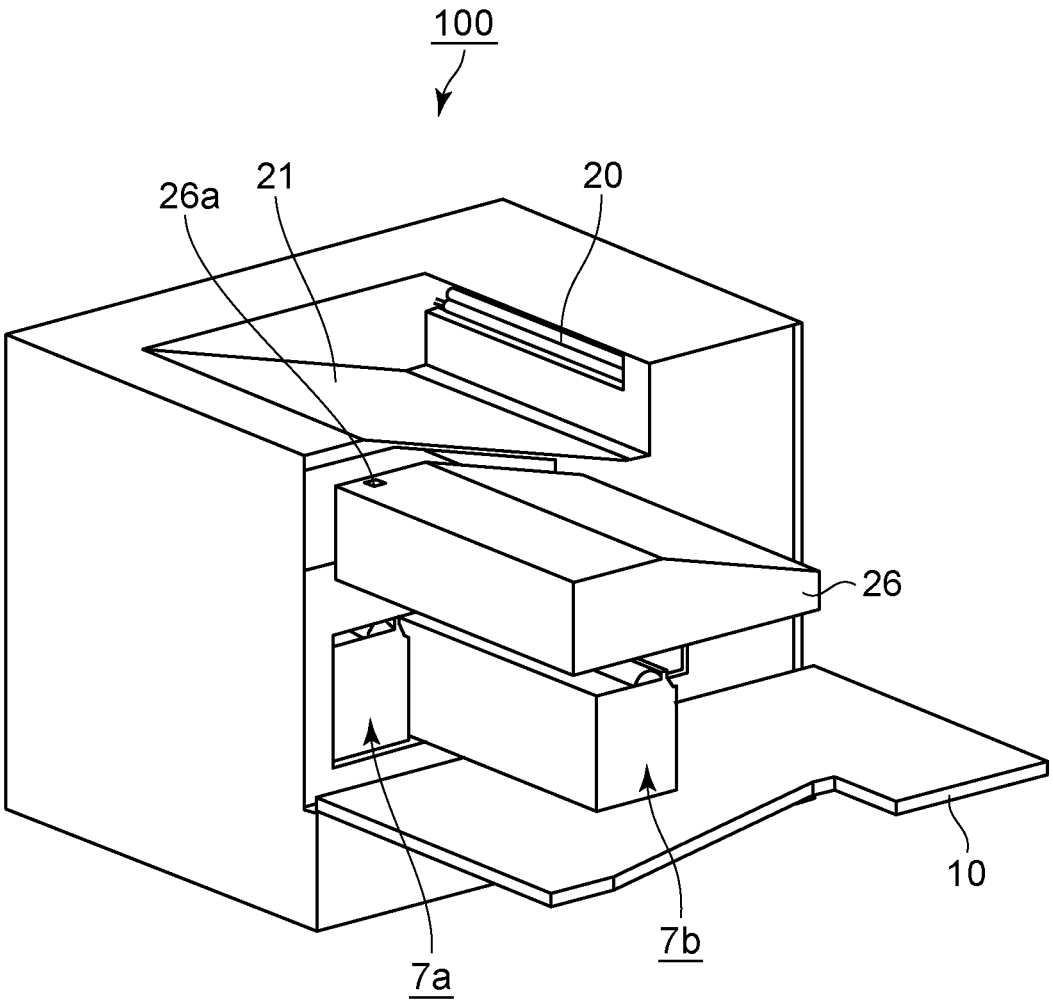
FIG. 5 is a perspective view illustrating part of the image forming apparatus according to the embodiment.

FIG. 5 illustrates an example of an opening/closing cover 10 according to the present embodiment.

The opening/closing cover 10 is disposed on the front side of the image forming apparatus 100 so as to be able to open frontward. When the opening/closing cover 10 is in an open state, a user can access the processing cartridges 7 and toner collecting container 26. In other words, in the present embodiment, the opening/closing cover 10 exposes the processing cartridges 7 and the toner collecting container 26 in the open state (at the open position) and covers the processing cartridges 7 and the toner collecting container 26 in a closed state (at a closed position). Put another way, the opening/closing cover 10 is attached to the main body of the image forming apparatus and is configured to be movable between the open position at which the toner collecting container is exposed and the closed position at which the toner collecting container is covered.

Replacement of Processing Cartridge and Toner Collecting Container

In the present embodiment, both of the processing cartridges 7 and the toner collecting container 26 become detachable/attachable by opening the opening/closing cover 10, and it is not necessary to provide an excessive area dedicated to the replacement of consumables, which leads to space saving. The processing cartridges 7 and the toner collecting container 26 can be accessed by using a single opening/closing cover 10 without providing opening/closing covers 10 individually.

In addition, the processing cartridges 7 and the toner collecting container 26 are disposed so as not to overlap each other in the view of FIG. 1. Accordingly, a user can attach/detach each component independently without affecting other components, which leads to simple operation (see FIG. 5). In other words, when the toner collecting container 26 is viewed in the attaching/detaching direction, the processing cartridges 7 do not overlap the toner collecting container 26.

When a user attaches/detaches the toner collecting container 26, the user needs to hold the toner collecting container 26, and the opening 26*a* for collecting toner is provided at a deeper position in the attaching/detaching direction. Accordingly, the user can complete replacement without touching the opening 26*a* during attachment/detachment of the toner collecting container 26 (see FIG. 5).

In addition, the opening 26*a* is provided on the upper surface of the toner collecting container 26. This suppresses the likelihood of toner spilling from the toner collecting container 26 and the likelihood of the toner soiling the periphery and the interior of the image forming apparatus 100 during attachment/detachment of the toner collecting container 26.

As described above, the toner collecting container 26 is disposed, in an attachable/detachable manner, in a region above the processing cartridges 7 and the intermediate transfer belt 12*e* within the image forming apparatus 100. Thus, during replacement of units, respective movement paths of the units to be replaced do not interfere with each other, which enables the units to be replaced in the same direction (in the direction from the front side of the image forming apparatus in this embodiment). In other words, while the opening/closing cover 10 disposed on the front side is open, both of the toner collecting container 26 and the processing cartridges 7 can be replaced.

Moreover, the volume of the toner collecting container 26 can be increased without directly affecting the size of the image forming apparatus 100 in the width direction (in the right-left direction in FIG. 1) as well as in the depth direction (in the longitudinal direction of a photosensitive member in FIG. 1).

Thus, ease in replacing the toner collecting container and a decrease in the size of the image forming apparatus can be made compatible with each other without increasing the size, which improves usability.

Figure 6:
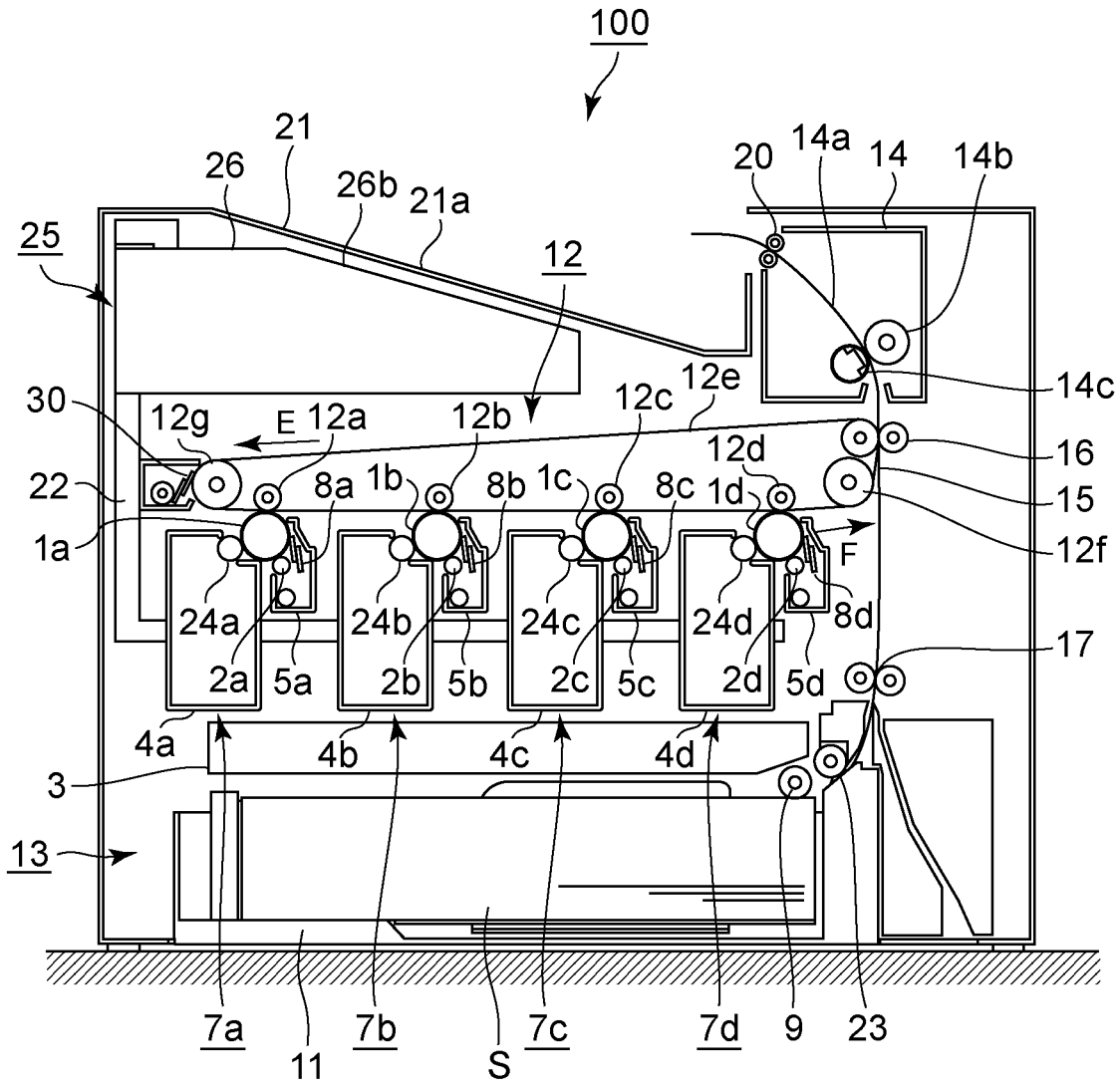
FIG. 6 is a cross-sectional view illustrating part of another image forming apparatus according to the embodiment.
Figure 7:
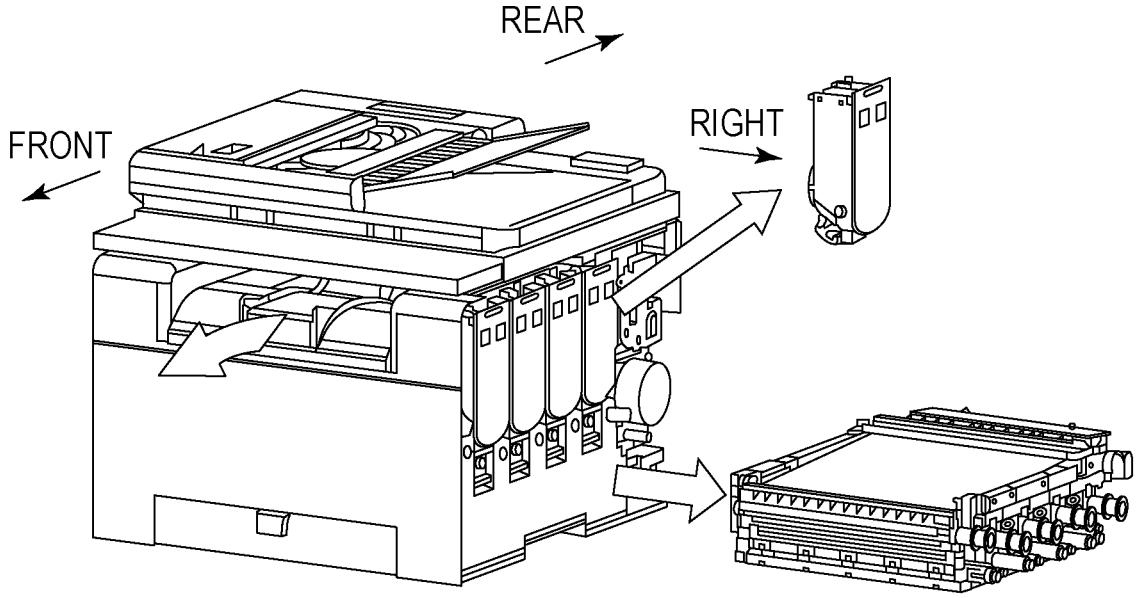
FIG. 7 is a diagram illustrating a known image forming apparatus.
Figure 8:
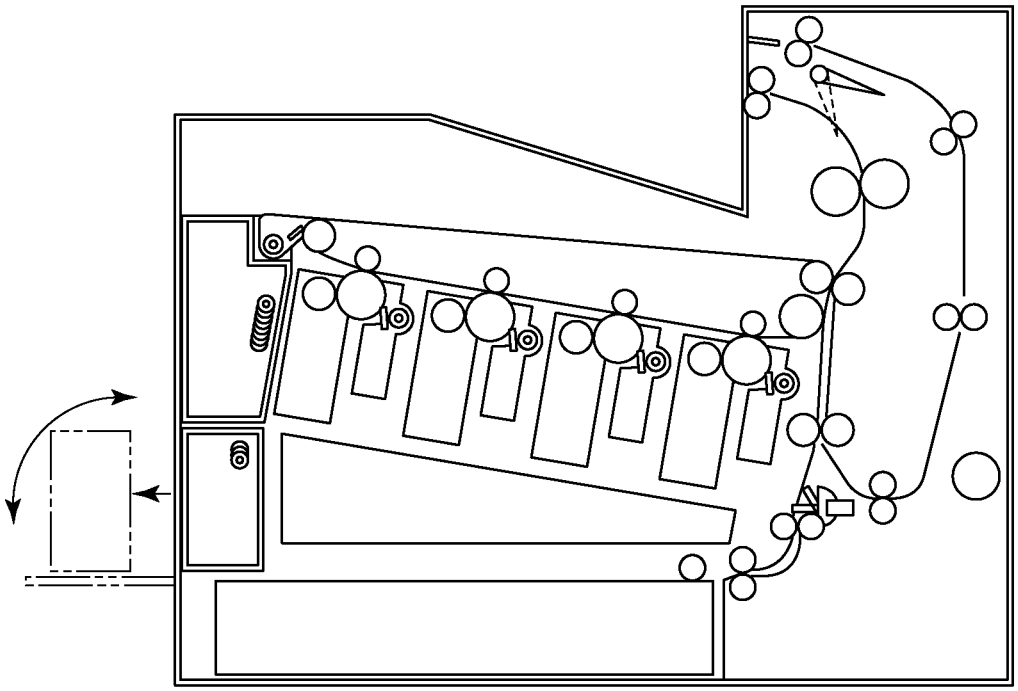
FIG. 8 is a diagram illustrating another known image forming apparatus.

The toner collecting container described above collects the residual toner that has not been transferred from and has remained on the intermediate transfer belt. However, the disclosure is not limited to this configuration. For example, as illustrated in FIG. 6, the toner collecting container may be configured such that the toner that has not been transferred from and has remained on the photosensitive drums is collected temporarily in the cleaner case. The toner collected temporarily is subsequently conveyed to the toner conveying path by the toner conveying device and collected into the toner collecting container via the toner conveying path. In this case, both of the residual toner that has not been transferred from the intermediate transfer belt and the residual toner than has not been transferred from the photosensitive drums can be collected into the toner collecting container. With this configuration, the cleaner case does not need to be as large as that of the processing cartridge illustrated in FIG. 1, which contributes to a reduction in the size of the apparatus. Moreover, with this configuration, all of the residual toner is collected by the toner collecting container, and thereby the replacement of the processing cartridges can be less frequent in the case in which the processing cartridges need to be replaced due to respective cleaner cases being filled with residual toner.

According to the disclosure, the capacity of the toner collecting container is generally obtained by utilizing the space above the intermediate transfer member, which can reduce the need for the upsizing of the image forming apparatus.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of priority from Japanese Patent Application No. 2018-022021, filed Feb. 9, 2018, which is hereby incorporated by reference herein in its entirety.

What is claimed is:

1. An image forming apparatus, comprising:

a plurality of cartridges that is detachable from a main body of the image forming apparatus and forms a toner image in accordance with image information;

an intermediate transfer member that carries the toner image transferred;

a transfer portion that transfers the toner image carried by the intermediate transfer member onto a recording medium;

a cleaning portion that collects toner remaining on the intermediate transfer member;

a toner collecting container into which the toner conveyed from the cleaning portion is collected; and a cover that is movable between an open position at which the toner collecting container is exposed and a closed position at which the toner collecting container is covered, wherein the toner collecting container is disposed in a region above the intermediate transfer member, and the intermediate transfer member is disposed in a region above the plurality of the cartridges, and wherein the toner collecting container is detachable from the main body in a state in which the cover is at the open position and the toner collecting container does not overlap the plurality of the cartridges when the toner collecting container is viewed in a direction of attaching and detaching a cartridge of the plurality of the cartridges.

2. The image forming apparatus according to claim 1, wherein the toner collecting container and the cartridge are attachable/detachable to and from the main body in a state in which the cover is at the open position.

3. The image forming apparatus according to claim 2, wherein the cartridge and the toner collecting container do not overlap each other as viewed in a direction of attaching and detaching the toner collecting container.

4. The image forming apparatus according to claim 3, wherein the direction of attaching and detaching the toner collecting container is parallel to a direction of attaching and detaching the cartridge.

5. The image forming apparatus according to claim 1, wherein the cleaning portion includes a toner conveying portion that conveys toner to the toner collecting container, the toner conveying portion has a discharge port from which the toner conveyed is discharged into the toner collecting container, the toner collecting container has a collection opening that engages the discharge port, and the collection opening is provided on an upper surface of the toner collecting container.

6. The image forming apparatus according to claim 5, wherein the collection opening is provided on the upper surface at a position away from the cover in the direction of attaching and detaching the toner collecting container.

7. The image forming apparatus according to claim 1, further comprising:

a stacking portion that has a first inclined surface on which the recording medium having the toner image is stacked, wherein the toner collecting container has a second inclined surface at a position opposing the first inclined surface.

8. The image forming apparatus according to claim 7, wherein the toner collecting container has a collection opening through which toner is collected, and the second inclined surface declines to a level below a position at which the collection opening is provided.

9. The image forming apparatus according to claim 1, wherein the cartridge has a photosensitive member for forming the toner image and wherein in a longitudinal direction of the photosensitive member, a length of the toner collecting container is greater than a length of the intermediate transfer member.

10. The image forming apparatus according to claim 1, wherein the toner collecting container overlaps the intermediate transfer member as viewed in the direction of gravity, and the toner collecting container is disposed such that the area of the overlapping portion is greater than or equal to 50% and less than or equal to 90% of the area of the toner collecting container, where the area of the toner collecting container is 100%.

* * * * *